US005725750A

United States Patent [19]

Tsubouchi et al.

[11] Patent Number: 5,725,750

[45] Date of Patent: Mar. 10, 1998

[54] PROCESS FOR PRODUCING POROUS IRON METAL BODY

[75] Inventors: Toshiyasu Tsubouchi; Tomohiko Ihara, both of Itami, Japan

[73] Assignee: Sumitomo Electric Industries, Ltd., Japan

[21] Appl. No.: 828,251

[22] Filed: Mar. 26, 1997

[30] Foreign Application Priority Data

| | | | |
|---|---|---|---|
| Apr. 19, 1996 | [JP] | Japan | 8-898623 |
| Feb. 21, 1997 | [JP] | Japan | 9-937968 |

[51] Int. Cl.[6] ..... C25D 1/08; C25D 3/20

[52] U.S. Cl. ..... 205/75; 205/224; 205/255; 205/256

[58] Field of Search ..... 205/75, 150, 224, 205/256, 255

[56] References Cited

U.S. PATENT DOCUMENTS

| | | | |
|---|---|---|---|
| 3,549,505 | 12/1970 | Hanusa | 428/613 |
| 3,694,325 | 9/1972 | Katz et al. | 205/75 |
| 4,053,371 | 10/1977 | Towsley | 205/50 |
| 4,077,853 | 3/1978 | Coll-Palagos | 205/75 |
| 4,435,252 | 3/1984 | Kadija | 205/75 |

FOREIGN PATENT DOCUMENTS

| | | | |
|---|---|---|---|
| 2046946 | 4/1971 | Germany | 205/75 |
| 57-39317 | 8/1982 | Japan . | |
| 59-35696 | 2/1984 | Japan | 205/75 |
| 61-76686 | 4/1986 | Japan . | |
| 63-15999 | 4/1988 | Japan . | |
| 64-75694 | 3/1989 | Japan . | |
| 1-255686 | 10/1989 | Japan . | |
| 2-70068 | 3/1990 | Japan . | |
| 4-116196 | 4/1992 | Japan . | |
| 8-60508 | 3/1996 | Japan . | |
| 1263704 | 2/1972 | United Kingdom . | |

*Primary Examiner*—Kathryn L. Gorgos
*Assistant Examiner*—William T. Leader
*Attorney, Agent, or Firm*—Bierman, Muserlian and Lucas LLP

[57] ABSTRACT

A process, particularly a continuous process, for industrially producing a high-quality inexpensive porous iron metal while preventing the conventional rusting problem which process comprises coating the surface of a conductive porous base material by iron electroplating, removing the base material, and then reducing the coating. The iron electroplating was conducted in an acid iron plating bath which contains at least one from acid aluminum compound and/or at least one acid titanium compound, using an anode which contains at least either of aluminum and titanium and has a surface area not smaller than ⅓ of and not larger than that of the base material. The reduction is conducted by a two-step heat treatment for improving the iron structure and for softening.

6 Claims, 1 Drawing Sheet

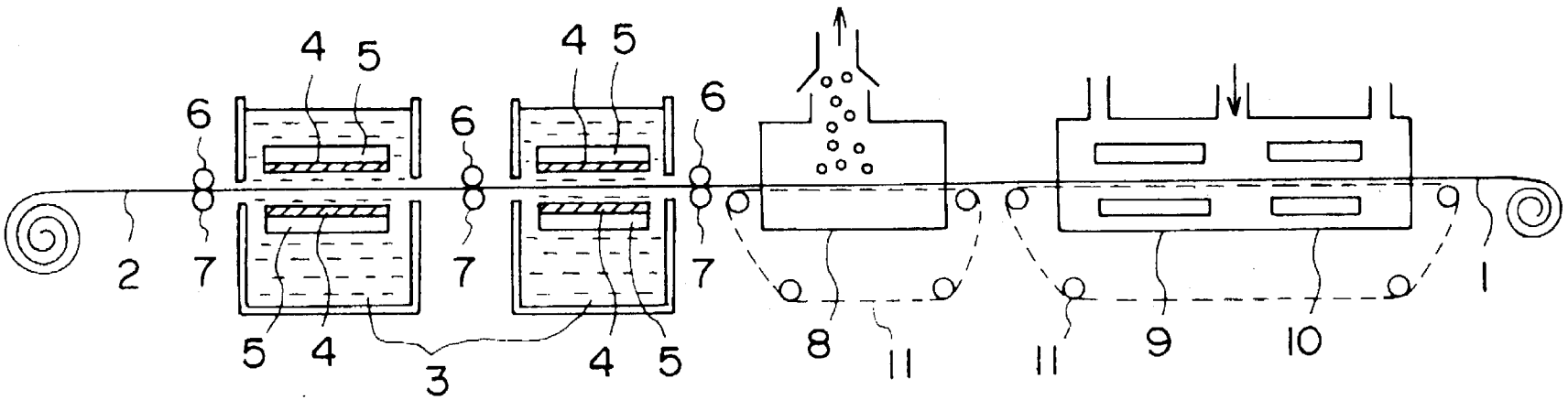
1
10
9
11
11
8
6
7
5
4
5
4
3
6
7
5
4
4
5
6
7
2

PROCESS FOR PRODUCING POROUS IRON METAL BODY

BACKGROUND OF THE INVENTION

1. Field of the Invention

The present invention relates to a process for producing a porous iron metal body usable in applications such as batteries, filters, catalysts, etc., where porous metal structures are used. More particularly, it relates to a continuous process for producing a porous iron metal body.

2. Description of the Prior Art

Porous metals are used in filters for dust collection from gases or for liquid filtration for electronic parts and in applications such as batteries etc. These filter materials are finely porous, foamed or fibrous metallic materials because they are required to have the property of catching a large quantity of fine particles. A process for obtaining such a metallic material having a high porosity and comprising 35 μm or thinner fibers has been put to practical use which comprises drawing metal wires and dispersing and sintering the resulting fibers. However, this process is undesirable in that it has a quality problem attributable to uneven fiber dispersion depending on materials, and that the process is costly because a high temperature is necessary for sintering. Another prior art process for obtaining a porous metal comprises electrodepositing nickel on a urethane or organic resin coated with a carbon powder or the like or on a nonwoven carbon fabric and then removing the base material; this process is disclosed in Japanese Patent Publication No. 57-39317 (1982), Japanese Patent Laid-Open No. 1-255686 (1989), and Japanese Patent Laid-Open No. 4-116196 (1992). Still another process for obtaining a porous metal is disclosed in Japanese Patent Laid-Open No. 61-76686 (1986), which comprises coating a felt or net material with a metal in a vacuum, subsequently electrodepositing nickel on the coated material, and then removing the base material. A further process for producing a porous metal body and use thereof as a catalyst material for $NO_x$ etc. are disclosed in Japanese Patent Laid-Open No. 8-60508 (1996). In this process, silver is electrodeposited on a nonwoven carbon fabric in which the organic binder present at carbon fiber junction points has been carbonized, and the base material is then removed to obtain a porous metal.

However, with respect to porous iron materials widely used as filters, no process has been put to practical use which is capable of yielding a high-quality porous iron at a low cost through plating. This is because the porous iron materials obtainable by any prior art iron plating process have drawbacks of: (1) poor surface smoothness, which renders the porous materials unsuitable for applications where evenness is required; (2) low strength and low toughness; and (3) susceptibility to corrosion. Consequently, iron plating has not been generally applied in practical use to a porous material comprising thin fibers because of its drawbacks in quality, production efficiency, and cost, although it has partly been put to practical use only in the field where it is necessary to form an outermost layer having a large thickness but not required to have smoothness, as in electrocasting.

Production of a porous material has the following problems.

(1) Since the material produced is porous, a plating solution or washing water is apt to remain therein and this causes a large quantity of rust. This rust as a scale is apt to cause clogging, making it difficult to stably obtain porous iron.

(2) The rust scale generated comes into the bath, and the iron anode itself dissolves into the bath considerably. Hence, the concentration of iron ions in the plating bath increases and this tends to result in an impaired balance. Especially in an iron plating bath, ferrous ions are apt to change into ferric ions with increasing iron ion concentration, and part of the accumulated iron ions become incapable of being present in a dissolved state and precipitate as a hydroxide. As a result, the plating efficiency decreases.

(3) The process has poor evenness of plating, and the porous body obtained is brittle and highly susceptible to corrosion. It is therefore difficult to stably produce a long size high-quality porous material comprising thin fibers.

SUMMARY OF THE INVENTION

An object of the present invention is to provide a process, in particular a continuous process, for industrially producing a high-quality inexpensive porous iron metal body reduced in rusting unlike conventional products, the process comprising coating the surface of a conductive porous base material by iron electroplating, removing the base material, and then reducing the coating.

As a result of intensive studies made by the present inventors, it has been found that the above object can be accomplished by: (1) adding at least one compound selected from the group consisting of acid aluminum compounds and acid titanium compounds to a plating bath to improve toughness and corrosion resistance and enable high-efficiency plating at a high current density; and (2) conducting a two-step heat treatment comprising a reduction reaction and subsequent softening to thereby enhance corrosion resistance and prevent reduction cracking, caused due to structure coarseness. This invention has been achieved based on the above.

The present invention comprises the following (1) to (6).

(1) A process for producing a porous iron metal body which comprises coating the surface of a conductive porous base material by iron electroplating, removing the base material by roasting, and then reducing the coating, in which an acid iron plating bath containing at least one compound selected from the group consisting of acid aluminum compounds and acid titanium compounds is used, an anode containing at least one selected from the group consisting of aluminum and titanium and having a surface area not smaller than ⅓ of and not larger than that of the base material to be plated is used and the reduction comprises a two-step heat treatment consisting of improving the iron structure and a subsequent softening.

(2) A process for producing a porous iron metal body as set forth in (1), in which the iron electroplating bath is a ferrous sulfate bath containing, as major components, 180 to 400 g/liter of ferrous ammonium sulfate ($FeSO_4 \cdot (NH_4)_2SO_4 \cdot 6H_2O$), 30 to 70 g/liter of ferrous chloride, 20 to 50 g/liter of aluminum sulfate, 20 to 50 g/liter of titanous sulfate and a pH buffer and has a pH of 3.0 to 3.8 and a temperature of 35° to 55° C.

(3) A process for producing a porous iron metal body as set forth in (1), in which the conductive porous base material is a carbon-coated urethane foam, carbon-coated organic fibers mutually bound with a resin or a nonwoven carbon fabric.

(4) A process for producing a porous iron metal body as set forth in (1), in which the roasting is conducted at a temperature of 600° to 700° C.

(5) A process for producing a porous iron metal body as set forth in claim 1, in which the heat treatment for the reduction is conducted in a pattern consisting of heating at 700° to 900° C. for structure improvement, followed by heating at 1,000° to 1,100° C. for softening.

(6) A process for producing a porous iron metal body as set forth in any one of (1) to (5), in which said process is continuously performed.

BRIEF DESCRIPTION OF THE DRAWINGS

The single figure is a flow diagram illustrating the process for producing iron.

DETAILED DESCRIPTION OF THE PREFERRED EMBODIMENTS

The present invention is explained below in detail.

The conductive porous base material used as a starting material in the present invention is an organic or inorganic foam or a woven or nonwoven fabric and has a conductive surface. Preferred examples of the base material include a carbon-coated urethane foam, carbon-coated organic fibers mutually bound with a resin, and a nonwoven carbon fabric. Examples of the organic fibers include natural organic fibers comprising, for example, cotton, silk, wool or pulp, and synthetic fibers comprising, for example, polyester, polyurethane, polyether-ester, polyamide or polyethylene. As the binding resin for these fibers, there may be mentioned polyvinyl-alcohl (PVA), phenol-resin, epoxy-resin, etc.

An acid bath is used in the present invention to electrodeposit an iron layer on the surface of a porous metal. The acid bath is preferably a sulfate bath containing ferrous ammonium sulfate ($FeSO_4 \cdot (NH_4)_2SO_4 \cdot 6H_2O$) as the main ingredient, because the sulfate bath is less corrosive and usable at a lower temperature than hydrochloride baths. However, since a bath containing a sulfate alone cannot have a sufficiently high iron ion concentration, ferrous chloride is added thereto in an amount of 30 to 70 g/liter to improve plating efficiency. The bath contains ferrous ammonium sulfate as the main ingredient in an amount of 180 to 400 g/liter and a pH buffer. The bath used in this invention further contains at least one compound selected from the group consisting of acid aluminum compounds and acid titanium compounds, which are the most important for the (continuous) iron plating of a porous body. Especially preferred acid aluminum compounds and acid titanium compounds are aluminum sulfate and titanous sulfate, because use of these compounds results in reduced fluctuations of the concentration of the main ingredient in the bath.

If the content of ferrous ammonium sulfate in the bath is lower than 180 g/liter, unevenness of plating occurs due to the too low iron ion concentration. If the content of ferrous ammonium sulfate is higher than 400 g/liter, not only do the excess iron ions in the bath cause iron electrodeposition within the solution, resulting in a porous iron having a rough surface, but also the bath is apt to have an increased ferric ion concentration, resulting in a reduced current efficiency and increased electrodeposition stress. The addition of ferrous chloride to the ferrous ammonium sulfate bath in an amount of 30 to 70 g/liter is effective in increasing the concentration of iron ions and regulating the electrical conductivity of the bath to about 0.11 S/cm to attain a cathode current efficiency of 90% or higher.

It should however be noted that ferrous chloride concentrations exceeding 70 g/liter are undesirable for industrial production because severe bath oxidation and corrosion and severe equipment corrosion result. On the other hand, the pH buffer used in combination with ferrous chloride is an ingredient necessary for stable plating (or maintaining a high plating efficiency), and is selected from general buffers including boric acid, citric acid, ammonium formate, and manganese formate. In the case of adding aluminum sulfate, amounts thereof smaller than 20 g/liter are undesirable in that insufficient corrosion resistance results and rust scales generate to cause clogging, while amounts thereof exceeding 50 g/liter are undesirable in that the relative iron concentration in the bath decreases to lower plating efficiency. In the case of adding titanous sulfate, amounts thereof smaller than 20 g/liter are undesirable in that insufficient toughness and insufficient corrosion resistance result and rust scales generate to cause clogging, while amounts thereof exceeding 50 g/liter are undesirable in that the relative iron concentration in the bath decreases to lower plating efficiency.

The addition of acid aluminum compounds and/or acid titanium compounds such as aluminum sulfate and titanous sulfate, which is a feature of the present invention, enables the porous body obtained to have enhanced toughness and be prevented from suffering severe corrosion after plating. The enhanced toughness eliminates the breakage trouble occurring in the conventional continuous production of a long size material, and the improved corrosion resistance renders the porous body less corroded by washing water remaining in the pores thereof. Compared to the conventional technique for improving corrosion resistance by using a solution containing particles of $Al_2O_3$ or $TiO_2$ to conduct codeposition plating, the present invention enables high-speed plating at high current efficiency without lowering the cathode current efficiency, due to the dissolved state of the aluminum and/or titanium compounds.

The bath being used is regulated to have a pH of 3.0 to 3.8 and a bath temperature of 35° to 55° C. If the pH is below 3.0, iron electrodeposition occurs within the bath, resulting in a porous iron having a rough surface, and the bath is apt to have an increased ferric ion concentration, resulting in a reduction in current efficiency and an increase in electrodeposition stress. If the pH exceeds 3.8, an iron ingredient in the bath is oxidized to ferric hydroxide, which precipitates to foul the plating tank. If the bath temperature is lower than 35° C., the plating rate is too low, resulting in reduced gloss and unevenness of plating. If the bath temperature is higher than 55° C., an iron ingredient in the bath is oxidized to ferric hydroxide, which precipitates to foul the plating tank.

In conventional iron plating, a large amount of iron dissolves from the iron anode into the bath, and iron ions accumulate therein during continuous operation to cause problems of precipitation and impaired quality. In the present invention, an anode plate having a surface area not smaller than ⅓ of and not larger than that of the body to be plated is used in place of a conventional spherical anode having a large surface area, whereby excessive dissolution into the bath can be prevented. Further, use of an anode containing aluminum and/or titanium metals in the continuous iron plating of a porous body is advantageous in that replenishment is easy and a plated porous body of stable quality can be continuously produced.

When electroplating is used in accordance with the present invention, the roasting and reduction steps are important. This is because nickel plating, which is in wide industrial use, can provide a satisfactory metal crystallinity, whereas iron plating is incapable of giving a deposit with sufficient material properties because of insufficient crystallinity in the plating step. Therefore, in the present invention, the drawback of the insufficient crystallinity of iron has been eliminated by improving the structure of iron in the roasting and reduction steps, unlike a process in which satisfactory crystallinity can be obtained in the plating step as in the production of porous nickel body. In the roasting step, the porous base material is removed preferably at 600° C. to 700° C. If roasting is conducted at a temperature below 600° C., the base material cannot be sufficiently removed and the iron comes to have an increased carbon content and reduced toughness. If the roasting step is conducted at a temperature exceeding 700° C., abnormal iron oxidation occurs and the resulting oxidation scales cause framework damage. The present invention newly employs a two-step heat treatment for reduction in which heating for improving the iron structure and heating for softening are separately conducted so as to be suitable for continuous production, whereby the cracking caused by thermal strain during reduction is prevented and a high-quality porous body can be obtained. In carrying out these steps, the heating and cooling before and after the treatment can be conducted rapidly without causing thermal strain. A small furnace can be used and the energy consumption is small. The heating for structure improvement is conducted preferably at 700° to 900° C., which is the a to γ transformation temperature, while that for softening is conducted preferably at 900° to 1,100° C., which is the annealing temperature.

The process of the present invention is especially suitable for the continuous production of a porous iron metal body. The figure shows a flow diagram illustrating one embodiment of the continuous production of a porous iron metal body. As shown in the figure, a porous base material 2 is introduced into two iron plating tanks 3. Two anodes 5 each supported on an anode support 4 have been disposed in each of the tanks 3 so that the porous base material is sandwiched therebetween. The iron-plated porous base material 2 is passed through a roasting zone 8 by means of a transfer belt 11, during which the porous base material 2 is removed. The residual iron sheet is introduced into reduction zones 9 and 10 into which hydrogen is kept being fed. The first reduction zone 9 is used for crystallization and densification (iron structure improvement), while the following second reduction zone 10 is used for softening. The continuous porous iron metal body I thus produced is wound into a roll.

provides a stable metal body having an improved corrosion resistance and toughness.

The present invention will be explained below by reference to Examples.

Examples 1 to 12 and Comparative Example 1

Organic fibers of polyester with a diameter of 7 μm were formed with a resin (PVA) into a nonwoven fabric having a thickness of 0.7 mm and a weight per unit area of 60 g/m$^2$. Carbon was applied onto the surface of the nonwoven fabric to render the fabric surface electrically conductive.

The nonwoven fabric thus obtained as a base material was heated at 700° C. for 1 hour in nitrogen gas and was subjected to continuous iron electroplating in each bath containing the salts shown in Table 1. The deposited metal amount was 420 g/m$^2$. In the iron plating, an anode containing aluminum and titanium was used and the area ratio of the surface area of the anode to that of the base material was ¾. Thus, porous metal bodies were obtained and were evaluated for (1) cathode current efficiency, (2) toughness, (3) occurrence of clogging in each porous body due to corrosion and (4) corrosiveness of each bath, which are important matters for industrial production. With respect to the occurrence of clogging, 10% of less is practical but further clogging is unsuitable for use.

TABLE 1

| | Ferrous ammonium sulfate (g/liter) | Ferrous chloride (g/liter) | Aluminum sulfate (g/liter) | Titanous sulfate (g/liter) | Cathode current efficiency (%) *1 | Flexural strength (kg/mm$^2$) | Occurrence of clogging in porous body *2 | Corrosion in bath *3 | Overall evaluation |
|---|---|---|---|---|---|---|---|---|---|
| Example | | | | | | | | | |
| 1 | 100 | 50 | 30 | 45 | 50 | 8 | no clogging | no corrosion | ○ |
| 2 | 180 | 40 | 35 | 25 | 90 | 10 | no clogging | no corrosion | ◎ |
| 3 | 300 | 50 | 40 | 40 | 92 | 10 | no clogging | no corrosion | ◎ |
| 4 | 400 | 60 | 25 | 35 | 90 | 10 | no clogging | no corrosion | ◎ |
| 5 | 500 | 50 | 45 | 30 | 80 | 10 | no clogging | no corrosion | ○ |
| Comparative Example 1 | 370 | 50 | 0 | 0 | 90 | 5 | clogging of 50% | no corrosion | x |
| Example | | | | | | | | | |
| 6 | 370 | 45 | 0 | 20 | 90 | 10 | clogging of 10% | no corrosion | ○ |
| 7 | 370 | 50 | 20 | 0 | 90 | 10 | no clogging | no corrosion | ◎ |
| 8 | 370 | 45 | 20 | 20 | 90 | 9 | no clogging | no corrosion | ◎ |
| 9 | 370 | 0 | 20 | 30 | 70 | 10 | no clogging | no corrosion | ○ |
| 10 | 370 | 30 | 50 | 40 | 90 | 10 | no clogging | no corrosion | ○ |
| 11 | 370 | 70 | 30 | 50 | 92 | 10 | no clogging | no corrosion | ◎ |
| 12 | 370 | 100 | 20 | 20 | 92 | 10 | no clogging | occurrence of rust in bath (0.3 g/liter) | ◎ |

*1: Percentage of metal deposition on the cathode depending on the amount of applied current (theoretically calculated value: 100%),
*2: State after a lapse of 3 hours (at room temperature) after washing with water,
*3: State after a lapse of 100 hours from the initiation of plating
◎: very good,
○: continuous plating is possible, and
x: poor Since iron constituting a porous metal body has a low specific gravity and is inexpensive, it is possible to produce a light-weight inexpensive material for use as a filter material and an electrode material for batteries. In the continuous production process comprising electroplating a porous material with iron, the present invention improves the cathode current efficiency and the stability of the plating bath, and Table 1 shows that the porous iron metal body produced using a plating bath containing aluminum sulfate and titanous sulfate is not corroded and has a strength sufficient to withstand circulation or shower pressure in the plating bath when conducting continuous plating of a long size material in the industrial production. Further, addition of ferrous chloride in an amount of 30 g/liter to 70 g/liter can prevent corrosion in a plating bath and ensure a high cathode current efficiency of at least 90%.

Examples 13–15 and Comparative Examples 2 and 3

Carbon fibers which had been baked at 1000° C. and had a diameter of 9 μm were formed into a nonwoven fabric having a weight per unit area of 40 g/m$^2$ and a thickness of 0.4 mm, using a resin (PVA). Then, the nonwoven carbon fabric thus obtained as a base material was heated at 700° C. for 1 hour in nitrogen gas and subjected to continuous iron electroplating in the same plating bath as in Example 3, using an anode containing Ti and Al shown in Table 2. The deposited amount was 550 g/m$^2$. The concentration of iron ions in the bath and occurrence of precipitation were examined after a lapse of 100 hours from the initiation of the plating. The results are shown in Table 2.

TABLE 2

Area ratio of the anode used for plating and increase in iron ion concentration and amount of iron precipitation

| | Area ratio of anode to body to be plated | Amount of metals included in anode (wt.%) Ti | Al | Increase in Fe ion concentra- *1 | Amount of precipitation of Fe (g/liter) |
|---|---|---|---|---|---|
| Comparative Example 2 | 1/4 | 0.5 | 0.5 | −30% | 0.01 |
| Example 13 | 1/3 | 1 | 2 | +0.5% | 0.05 |
| 14 | 1/2 | 2 | 0.5 | +1% | 0.1 |
| 15 | 1 | 0.5 | 2 | +2% | 0.2 |
| Comparative Example 3 | 2 | 2 | 1 | +10% | 2 |

$$*1: \frac{[\text{Fe ion concentration after 100 hrs from the initiation of continuous plating}] - [\text{Fe ion concentration before continuous plating}]}{\text{Fe ion concentration before continuous plating}}$$

When the surface area of the anode containing aluminum and titanium is smaller than ⅓ of that of the porous body to be plated, the Fe ion concentration in the plating bath decreases and Fe ions cannot be supplied in an amount sufficient for plating. Consequently, plating becomes difficult. On the contrary, the anode having a surface area greater than that of the porous body to be plated results in a significant Fe precipitation as large as 2 g/liter, thereby fouling the plating bath. As will be noted from the above, it is preferred for the industrial production that the anode have a surface area not smaller than ⅓ of and not larger than that of the base material to be plated.

Examples 16 to 19

Carbon fibers which had been baked at 800° C. and had a diameter of 13 μm were formed into a nonwoven fabric having a weight per unit area of 40 g/m$^2$ and a thickness of 0.7 mm using a resin (PVA). The nonwoven carbon fabric thus obtained as a base material was heated at 700° C. for 1 hour in nitrogen gas and then subjected to iron electroplating using the same plating bath and the anode as in Example 4. The deposited amount was 450 g/m$^2$. The resulting plated material was roasted at various temperatures shown in Table 3. The roasted materials were prereduced at 850° C. for 14 minutes and then reduced at 1,020° C. for 20 minutes for softening to obtain nonwoven iron fabrics. The nonwoven metal fabrics obtained were observed and evaluated for carbon content and cracking. Table 3 shows that the nonwoven metal fabrics obtained through roasting at 600° C. to 700° C. and subsequent reduction had been decarburized to a carbon content of 0.3 wt. % or lower and could have improved quality with no cracks after the reduction. When the extent of cracking is up to 10% with respect to the width of the porous metal body, strength can be ensured and portions where cracking has occurred can be removed after having finished the porous body into a desired product. However, when cracking rate reaches several tens %, the porous body cannot endure subsequent operations.

TABLE 3

| Example | Roasting temperature (°C.) | Carbon content (wt. %) | Cracking |
|---|---|---|---|
| 16 | 580 | 0.5 | no cracking |
| 17 | 650 | 0.2 | no cracking |
| 18 | 700 | 0.06 | no cracking |
| 19 | 750 | 0.06 | cracking of about 10% |

Examples 20 to 22

A carbon-coated polyurethane material as a base material was subjected to iron electroplating using the same plating bath and the anode as in Example 4. The deposited amount was 600 g/m$^2$. The plated material was roasted at 700° C. for 20 minutes, and porous metal body was obtained, using any of the various sets of reduction conditions shown in Table 4. The thus-obtained porous metals were observed and evaluated for cracking.

TABLE 4

| | Reduction pattern step 1 Heating rate (°C./min) | Roasting temperature (°C. × min) | step 2 Heating rate (°C./min) | Roasting temperature (°C. × min) | Cracking | Elongation (%) |
|---|---|---|---|---|---|---|
| Example 20 | 80 | 800 × 7 | 100 | 1050 × 30 | none | 3 |
| 21 | 80 | 800 × 7 | — | — | none | 0.2 |
| 22 | 80 | 800 × 7 | 100 | 900 × 30 | none | 0.7 |
| Comparative Example 4 | — | — | 70 | 1050 × 30 | cracking about 50% | 3 |

Table 4 shows that when the reduction pattern was a two-step heat treatment in which heating (step 1) at 700° C. to 900° C. was conducted prior to softening (step 2), the resultant material could have improved quality with reduced cracking. The results show that the two-step heat treatment was free from a breakage trouble after heating, unlike the conventional heat treatment in which cracking occurs during heating and the cracks lead to material breakage when tension is imposed for material withdrawal from the heating zone.

The present invention has enabled the production of a porous iron body improved in strength and toughness at a low cost while preventing cracking caused by thermal strain. Further, it is possible according to the present invention to stably and continuously mass-produce an inexpensive porous metal body using iron, an abundant element, and usable in filters, catalysts, etc.

What is claimed is:

1. A process for producing a porous iron metal body which comprises coating the surface of a conductive porous base material by iron electroplating, removing the base material by roasting, and then performing a reduction reaction on the coating, in which in the step of iron electroplating an acid iron plating bath comprising at least one compound selected from the group consisting of acid aluminum compounds and acid titanium compounds is used, and an anode containing at least one element selected from the group consisting of aluminum and titanium and having a surface area not smaller than ⅓ of and not larger than that of the base material to be plated is used; and the reduction reaction comprises a two-step heat treatment in which the iron structure is improved by increasing crystallization in a first step and subsequently softened in a second step.

2. A process for producing a porous iron metal body as set forth in claim 1, in which the iron electroplating bath is a ferrous sulfate bath comprising, 180 to 400 g/liter of ferrous ammonium sulfate ($FeSO_4 \cdot (NH_4)_2SO_4 \cdot 6H_2O$), 30 to 70 g/liter of ferrous chloride, 20 to 50 g/liter of aluminum sulfate, 20 to 50 g/liter of titanous sulfate and a pH buffer, and has a pH of 3.0 to 3.8 and a temperature of 35° to 55° C.

3. A process for producing a porous iron metal body as set forth in claim 1, in which the conductive porous base material is a carbon-coated urethane foam, carbon-coated organic fibers mutually bound with a resin, or a nonwoven carbon fabric.

4. A process for producing a porous iron metal body as set forth in claim 1, in which the roasting is conducted at a temperature of 600° to 700° C.

5. A process for producing a porous iron metal body as set forth in claim 1, in which the two-step heat treatment is conducted in a sequence consisting of heating at 700° to 900° C. for increasing crystallization, followed by heating at 1,000° to 1,100° C. for softening.

6. A process for producing a porous iron metal body as set forth in claim 1, in which said process is continuously performed.

* * * * *

UNITED STATES PATENT AND TRADEMARK OFFICE

CERTIFICATE OF CORRECTION

PATENT NO. : 5,725,750
DATED : March 10, 1998
INVENTOR(S) : Tsubouchi et al

It is certified that error appears in the above-indentified patent and that said Letters Patent is hereby corrected as shown below:

Title page, item

[30] Foreign Application Priority Data

Please change "8-898623" to --8-98623-- and "9-937968" to --9-37968--.

Signed and Sealed this

Thirtieth Day of June, 1998

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,725,750

DATED : March 10, 1998

INVENTOR(S) : Tsubouchi et al

It is certified that error appears in the above-indentified patent and that said Letters Patent is hereby corrected as shown below:

Column 3, line 6, change "iron" to --a porous iron metal body-- line 23, correct the spelling of "alcohol"

Column 5, line 29, after "roll.", insert --Reference numerals 6 and 7 represent rollers.--

Column 6, line 27, change "of" to ( 2nd occurence) to -- or --"

Column 10, lines 2 and 24, change "increasing crystallization" to --crystallization and densification--.

Signed and Sealed this

First Day of June, 1999

*Attest:*

Q. TODD DICKINSON

*Attesting Officer*

*Acting Commissioner of Patents and Trademarks*